US008282271B2

(12) United States Patent
Kressmann et al.

(10) Patent No.: US 8,282,271 B2
(45) Date of Patent: Oct. 9, 2012

(54) TIMEPIECE

(75) Inventors: Flavien Kressmann, Gaillard (FR); Ludovic Zbylut, Monnetier-Mornex (FR)

(73) Assignee: Rolex S.A., Geneva (CH)

( * ) Notice: Subject to any disclaimer, the term of this patent is extended or adjusted under 35 U.S.C. 154(b) by 242 days.

(21) Appl. No.: 12/824,667

(22) Filed: Jun. 28, 2010

(65) Prior Publication Data

US 2011/0013496 A1 Jan. 20, 2011

(30) Foreign Application Priority Data

Jul. 16, 2009 (EP) ..... 09405115

(51) Int. Cl.
*G04B 29/00* (2006.01)

(52) U.S. Cl. ..... 368/319; 368/308

(58) Field of Classification Search ..... 368/308, 368/190–193, 216, 76, 146–148, 31, 74, 368/185, 206–208, 150–151, 196
See application file for complete search history.

(56) References Cited

U.S. PATENT DOCUMENTS

| | | | | |
|---|---|---|---|---|
| 6,939,034 | B2 * | 9/2005 | Dubois | 368/190 |
| 7,563,020 | B2 * | 7/2009 | Pittet | 368/190 |
| 7,891,863 | B2 * | 2/2011 | Schafer | 368/185 |
| 2001/0046186 | A1 | 11/2001 | Dubois | |

FOREIGN PATENT DOCUMENTS

| | | | |
|---|---|---|---|
| CH | 36526 | A | 1/1907 |
| CH | 691632 | A5 | 8/2001 |
| DE | 202004001124 | U1 | 7/2004 |
| FR | 2059626 | A1 | 6/1971 |
| FR | 1134628 | A1 | 9/2001 |
| JP | 54-94348 | U | 7/1979 |

OTHER PUBLICATIONS

European Search Report of European Patent Application No. 09405115, issued Dec. 14, 2009.

* cited by examiner

*Primary Examiner* — Edwin A. Leon
(74) *Attorney, Agent, or Firm* — Westerman, Hattori, Daniels & Adrian, LLP

(57) ABSTRACT

This timepiece has a case (8) enclosing a horological movement (10), and a transmission mechanism for transmitting constant-velocity rotary movements between two stems (1*a*, 1*b*) on parallel axes, connecting the outside of the case (8) to the horological movement (10) through a hole in the case (8). The adjacent ends of the two stems (1*a*, 1*b*) are connected to two respective sliding elements (3, 6) having defined cross sections engaged with two respective slide-ways (4, 7) having cross sections complementary to those of the sliding elements, having sliding planes perpendicular to said axes, the two slide-ways (4, 7) being connected to a common linking member (5) and being oriented at an angle of 90° to each other.

10 Claims, 4 Drawing Sheets

TIMEPIECE

The present invention relates to a timepiece comprising a case enclosing a horological movement and a transmission mechanism for transmitting constant-velocity rotary movements between two stems on approximately parallel axes, connecting the outside of the case to the horological movement through a hole in the case, in which timepiece the adjacent ends of these two stems are connected to two respective sliding elements having defined cross sections engaged with two respective slide-ways having cross sections complementary to those of said sliding elements and oriented at an angle of 90° to each other, the two slide-ways being connected to a common linking member.

A transmission mechanism of this kind was disclosed in CH 36526. That mechanism has no defined sliding planes.

There are a number of different reasons why a stem of a transmission mechanism for transmitting a rotary movement may be positioned too far off centre compared with the lateral part of the watch case. Various other approaches have been put forward to avoid this eccentricity, which, besides being visually unsatisfactory, can be troublesome.

Examples of these approaches are CH 691632, DE 202004001124U, and EP 1134628. These approaches relate to mechanisms in which rotary movement is transmitted between the two parallel stems by means of gearwheels. Such mechanisms are complex, bulky and difficult to assemble, and can only be used to correct comparatively large inter-axial distances. They are not suitable for small inter-axial distances where it would not be possible to fit the gearwheels.

SUMMARY OF THE INVENTION

The object of the present invention is to solve, at least in part, the abovementioned problems.

For this purpose the present invention relates to a timepiece according to claim 1.

Preferably, in this timepiece, the respective complementary cross sections of the sliding elements and of the slide-ways have narrow parts, allowing mutual engagement and disengagement of the sliding elements and their respective slide-ways only by movement in their respective sliding planes, so that, once the sliding elements and their respective slide-ways are engaged in each other, the two stems are coupled to each other in axial translation.

BRIEF DESCRIPTION OF THE DRAWINGS

The accompanying drawings illustrate, schematically and by way of example, an embodiment and a number of variants of the timepiece of the invention.

DETAILED DESCRIPTION OF PARTICULAR EMBODIMENTS

Figure 1:
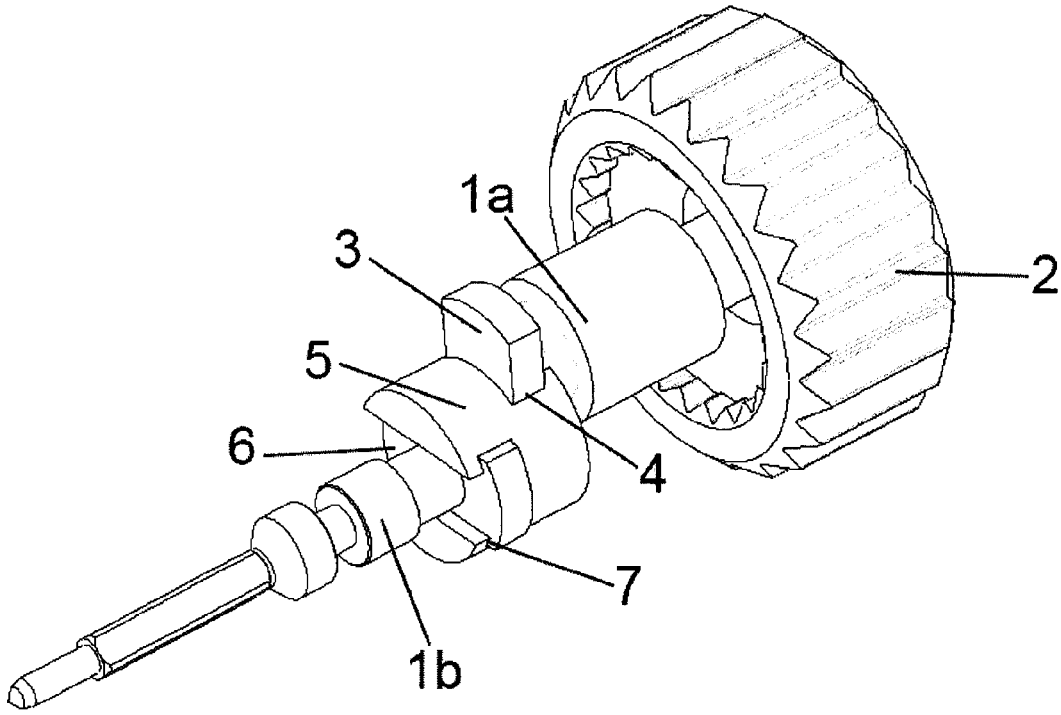
FIG. 1 is a perspective view showing the principle of operation of the transmission mechanism for transmitting a rotary movement in the timepiece of the invention.

The transmission mechanism illustrated in FIG. 1 has two stems 1*a*, 1*b* on parallel axes. One end of the stem 1*a* is connected to a central core of a driving crown 2 designed to be on the outside of a watch case (which is not shown in this figure). The other end of this stem 1*a* is connected to a sliding element 3 engaged in a slide-way 4 formed in one face of a linking member 5 and extending perpendicular to the axis of the stem 1*a*.

That end of the stem 1*b* which is adjacent to the stem 1*a* is connected to a sliding element 6 engaged in a slide-way 7 formed on another face of the linking member 5 and also extending perpendicular to the axis of the stem 1*b*. Since the two stems 1*a*, 1*b* are parallel, the two slide-ways 4 and 7 are also parallel. However, the orientations of these slide-ways 4 and 7 are perpendicular to each other. To allow sliding between the sliding elements and the respective slide-ways, the cross sections of the sliding elements are complementary to the cross sections of the respective slide-ways.

As can be seen particularly clearly in the case of the sliding element 6 and the slide-way 7, though it is also true of the sliding element 3 and the slide-way 4, their cross sections preferably have narrow parts, these cross sections here being T-shaped, allowing mutual engagement and disengagement of the sliding elements and their respective slide-ways only by movements in the respective sliding planes, so that once the sliding elements and the respective slide-ways are engaged in each other, the two stems are also coupled together in axial translation.

The two slide-ways 4 and 7 of the linking member 5 allow constant-velocity rotary movements to be transmitted between the two parallel stems 1*a*, 1*b*. Tests have shown that this transmission is silent and smooth and capable of transmitting a relatively large torque such as that required to wind up a mainspring. These tests have shown that it is possible to transmit rotation between two parallel stems offset axially by more than a millimetre from each other, without encountering any problems. The same mechanism can equally easily transmit rotation between two parallel stems with a much smaller axial offset.

Figure 2:
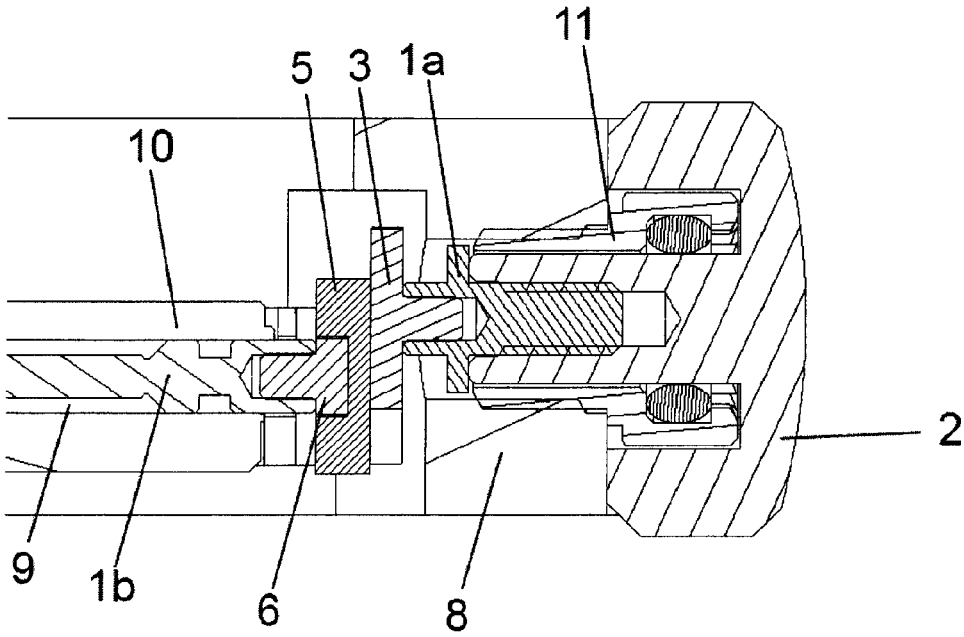
FIG. 2 is a partial view in section through a timepiece provided with this transmission mechanism.

The view in section in FIG. 2 illustrates an embodiment of this mechanism mounted partly on a bottom plate 10—the only part illustrated of a watch movement housed in a watch case (of which only the middle 8 has been shown) and partly through the middle 8. The stem 1*a* connected to the driving crown 2 is mounted in a tube 11 which is screwed into a hole passing through the middle 8, while the stem 1*b* is mounted in a hole 9 formed in the bottom plate 10.

In this embodiment, the sliding element 3 is connected to the stem 1*a* which is screwed into the central core 2*a* of the crown 2 from inside the middle 8. Next, the linking member 5 is introduced from underneath through the opening of the middle, the sliding elements 3 and 6 being engaged in succession in their respective slide-ways 4 and 7.

Figure 3:
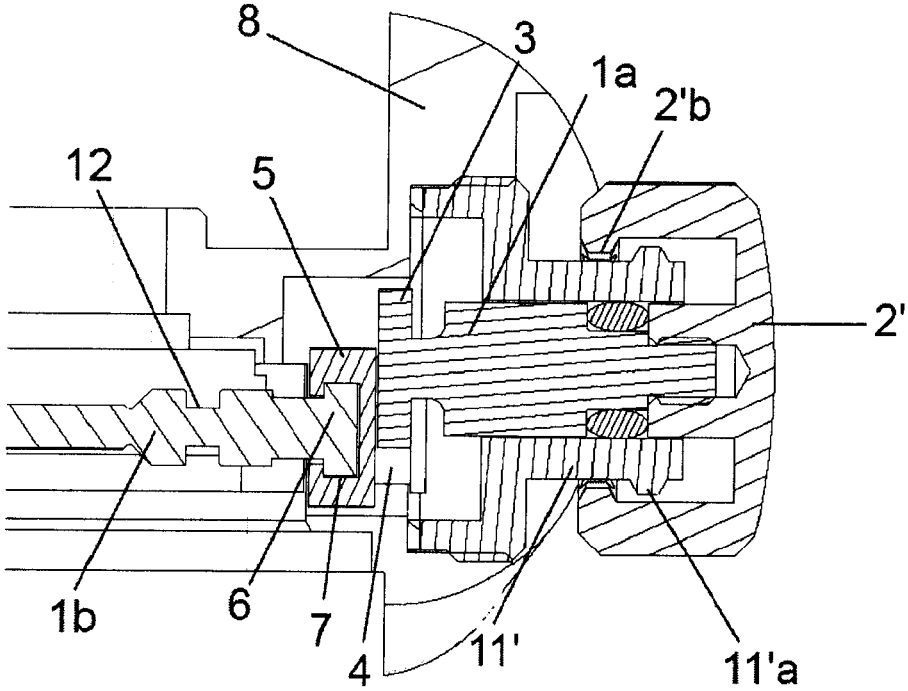
FIG. 3 is a partial view in section, similar to FIG. 2, through a variant of the transmission mechanism, corresponding to a section on the vertical plane of the mechanism shown in FIG. 1.

The variant illustrated in FIG. 3 has been designed to allow assembly of the transmission mechanism through the hole formed in the middle 8 for the control stem. This variant allows the diameter of the opening in the underside of the middle to be reduced, because the linking member 5 is no longer mounted through this opening.

For this purpose the outer end of the tube 11' has external teeth 11'*a* and the crown 2' has an internal piece 2'*b*. The teeth

11'*a* and 2'*b* can be replaced by polygonal sections or any other non-circular complementary sections suitable for coupling the crown 2' and the tube 11' in rotation. The stem 1*a*, 1*b* has three axial positions. To assemble the transmission mechanism, the crown 2' is placed in the tube 11' in such a way that its teeth 2'*b* engage with the teeth 11'*a* of the tube 11'. The linking member 5 is fitted by engaging the sliding element 3 into the slide-way 4 and the sliding element 6 of the stem 1*b* is inserted into the slide-way 7.

This assembly is then inserted through the lateral opening passing through the wall of the middle 8 and the tube 11' is screwed into the middle 8, turning it by means of the crown 2' whose teeth 2'*b* are engaged with the teeth 11'*a* of the tube 11'. Once the tube 11' is screwed in, the crown 2' is pushed towards the centre of the movement and the axial position of the assembly is locked, for example by screwing the pull-out piece (not shown), or by using a pin mounted with a spring on the pull-out piece, as is traditionally done in watches, to engage the pull-out piece stud in a groove 12 in the stem 1*b* in order to couple it to the pull-out piece. Once this is done, the stems 1*a*, 1*b* have the same function as the conventional winding stem with two axial positions, one for winding and the other for setting the time.

This variant does create a difficulty when it comes to keeping the teeth 2'*b* of the crown 2' engaged with the teeth 11'*a* of the tube 11', when assembling the transmission mechanism, to allow this tube 11' to be screwed in.

Figure 4A:
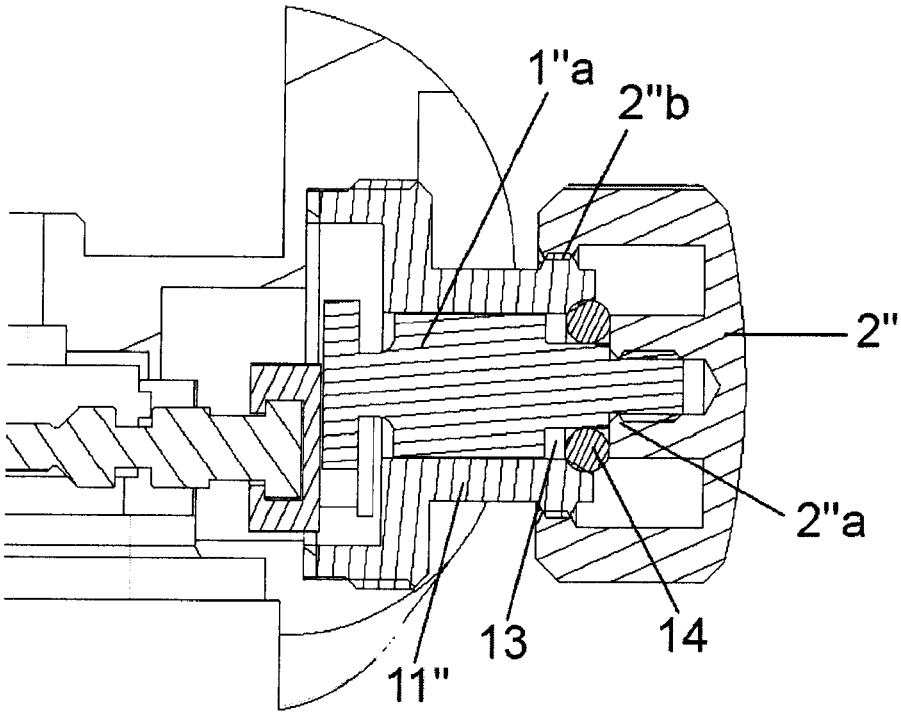
FIGS. 4*a*, 4*b* and 4*c* are views in section through another variant of the transmission mechanism illustrating different steps in its assembly.
Figure 4B:
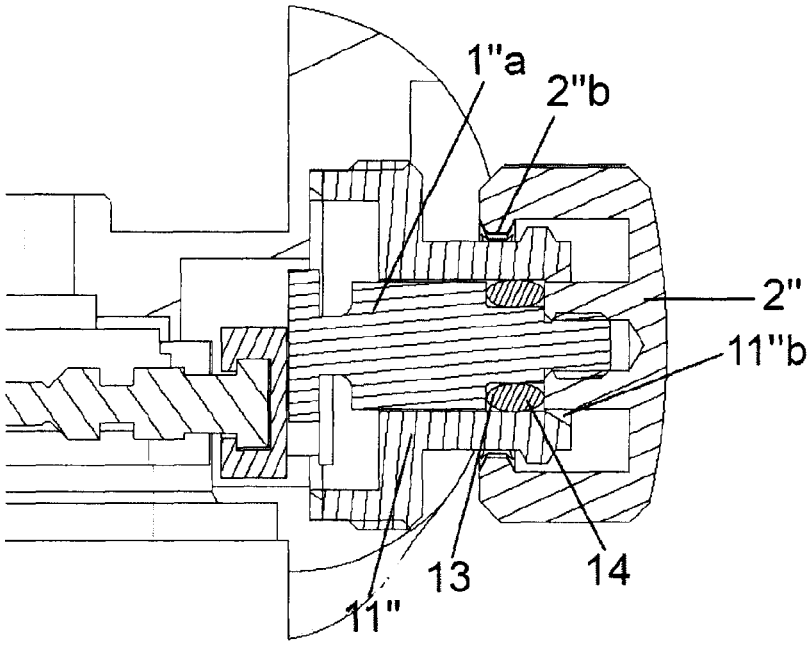
Figure 4C:
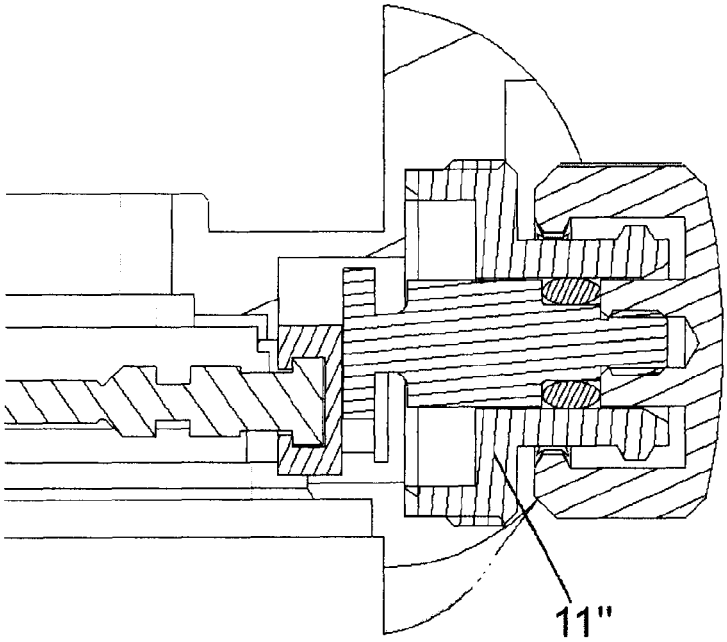

The variant illustrated in FIGS. 4*a*, 4*b*, 4*c* is designed to make this assembly problem easier.

For this purpose the outer end of the tube 11" has a conical recess 11"*b*, while an annular clearance 13 is formed between the central core 2"*a* of the crown 2" and the stem 1"*a*. An "O" ring 14 is housed partly in the annular clearance 13 and partly in the conical recess 11"*b*, keeping the crown 2" in the axial position in which its teeth 11"*a* are engaged with the teeth 2"*b* of the crown 2", as shown in FIG. 4*a*.

This positioning makes it much easier to screw the tube 11" in. Once the tube 11" is screwed in, the crown is pushed gently towards the centre of the watch to allow the pull-out piece to be screwed in as explained earlier. By pushing on the crown 2", the "O" ring 14 is compressed and pushed into the cylindrical part of the tube 11" next to the narrow base of the conical recess 11"*b*, so that the "O" ring 14 now acts as a seal.

Figure 5:
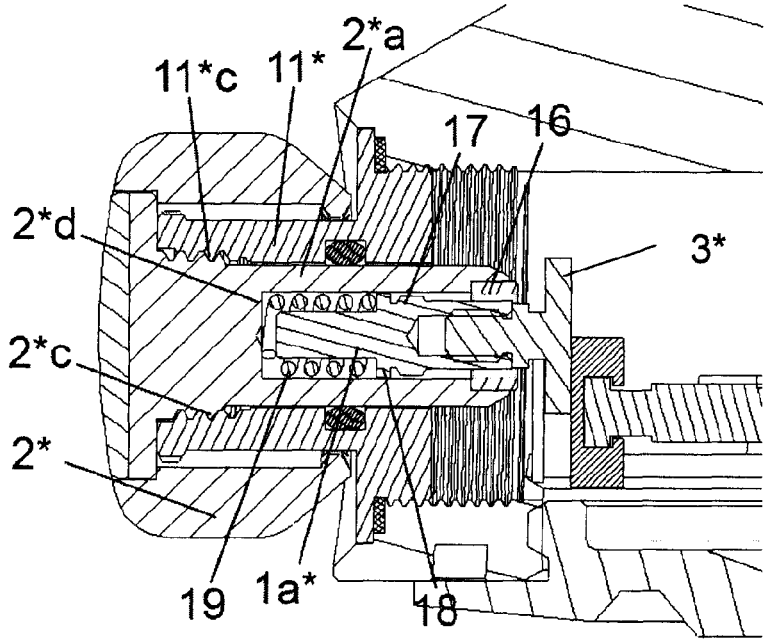
FIG. 5 is a partial view in section through a variant in which the crown mounted on the control stem is screwed onto the watch case in the rest position.
Figure 6:
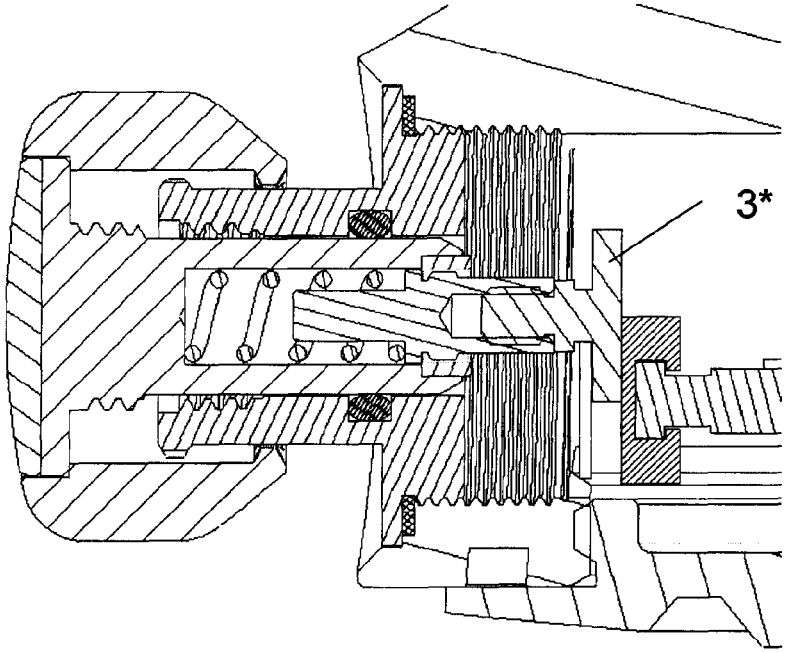
FIG. 6 is a view similar to FIG. 5 showing the crown in the unscrewed position.

The variant illustrated in FIGS. 5 and 6 differs from the previous embodiment essentially in that the crown 2* is screwed onto the tube 11* in the rest position, necessitating the provision of an extra axial position. This extra axial position is that between the unscrewed crown 2* shown in FIG. 6 and the screwed-in crown 2* shown in FIG. 5.

For this purpose the tube 11* has an internal thread 11**c* and the base of the central core of the crown 2* has a thread 2**c* designed to screw into the thread 11**c* in the tube 11*, as shown in FIG. 5.

During this screwing-in of the crown 2*, the crown 2* must be decoupled from the stem 1**a*. To decouple it, a sleeve 16, the cross section of the opening of which is non-circular, is attached to the base of the axial housing 2**d* (formed in the central core 2**a* of the crown 2*) in which the stem 1**a* is housed. The stem 1**a* meanwhile has a part 17 whose cross section is complementary to that of the opening of the sleeve 16. This stem 1**a* also has a collar 18 as a bearing for a spring 19 which is compressed between this collar 18 and the closed end of the housing 2**d*. This collar 18 also serves to limit the relative axial movement between the crown 2* and the stem 1**a* when the crown is unscrewed. As shown in FIG. 6, in this position the collar 18 comes into contact with the sleeve 16.

As can be seen from the foregoing description, the transmission mechanism for transmitting movements between two stems on parallel axes is very simple and compact. Unlike mechanisms using gearwheels, the same mechanism can be used for different spacings between the parallel axes of the stems 1*a*, 1*b*. It requires no more than two or perhaps three extra parts compared with a conventional winding mechanism, specifically a second stem and a linking member and optionally a separate sliding element 3*, as in the embodiment shown in FIGS. 5 and 6, to allow the sleeve 16 to be secured after inserting the spring 19 and the stem 1**a*.

The invention claimed is:

1. Timepiece comprising a case enclosing a horological movement and a transmission mechanism for transmitting constant-velocity rotary movements between two stems on approximately parallel axes, connecting the outside of the case to the horological movement through a hole in the case, wherein the adjacent ends of these two stems are connected to two respective sliding elements having defined cross sections engaged with two respective slide-ways having cross sections complementary to those of said sliding elements, oriented at an angle of 90° to each other, the two slide-ways being connected to a common linking member;

and wherein the sliding planes of said slide-ways are perpendicular to said axes.

2. Timepiece according to claim 1, in which the respective complementary cross sections of the sliding elements and of the slide-ways have narrow parts, allowing mutual engagement and disengagement of the sliding elements and their respective slide-ways only by movement in their respective sliding planes, so that the two stems are coupled to each other in axial translation once the sliding elements and their respective slide-ways are engaged in each other.

3. Timepiece according to claim 1, in which the outer end of the stem passing through the hole in the case is connected to a driving crown, the hole in the case comprising a screw thread for attachment of a tube, the inner face of the crown comprising a portion of non-circular cross section and the outer end of the tube comprising a portion of non-circular cross section complementary to that of the crown in order to allow the tube to be screwed into the hole in the case by means of the crown.

4. Timepiece according to claim 3, in which the inside face of the outer end of said tube has a conical recess, while an annular clearance is formed between the central core of the crown and the stem, an "SO" ring being housed partly in the annular clearance and partly in the conical recess, in such a way as to hold the crown in the axial position in which its portion of non-circular cross section is in engagement with the portion of complementary non-circular cross section of the crown and to allow said "0" ring to be engaged in the cylindrical part of said tube once the tube is screwed into the hole in the case.

5. Timepiece according to claim 3, in which the end of the stem connected to the driving crown is mounted with axial play in a housing in the central core of said crown and comprises a part of non-circular cross section for engaging with a part of complementary cross section connected to said central core, elastic means being interposed between said stem and said crown to tend to bring the two parts of complementary non-circular cross sections into engagement with each other, said crown and said tube each comprising a screw thread suitable for screwing into each other and causing axial displacement of said crown against the pressure of said elastic means, causing separation of the two parts of complementary cross sections of said stem and said crown from each other.

6. Timepiece according to claim 4, in which the end of the stem connected to the driving crown is mounted with axial play in a housing in the central core of said crown and comprises a part of non-circular cross section for engaging with a part of complementary cross section connected to said central core, elastic means being interposed between said stem and said crown to tend to bring the two parts of complementary non-circular cross sections into engagement with each other, said crown and said tube each comprising a screw thread suitable for screwing into each other and causing axial displacement of said crown against the pressure of said elastic means, causing separation of the two parts of complementary cross sections of said stem and said crown from each other.

7. Timepiece according to claim 2, in which the outer end of the stem passing through the hole in the case is connected to a driving crown, the hole in the case comprising a screw thread for attachment of a tube, the inner face of the crown comprising a portion of non-circular cross section and the outer end of the tube comprising a portion of non-circular cross section complementary to that of the crown in order to allow the tube to be screwed into the hole in the case by means of the crown.

8. Timepiece according to claim 7, in which the inside face of the outer end of said tube has a conical recess, while an annular clearance is formed between the central core of the crown and the stem, an "SO" ring being housed partly in the annular clearance and partly in the conical recess, in such a way as to hold the crown in the axial position in which its portion of non-circular cross section is in engagement with the portion of complementary non-circular cross section of the crown and to allow said "0" ring to be engaged in the cylindrical part of said tube once the tube is screwed into the hole in the case.

9. Timepiece according to claim 7, in which the end of the stem connected to the driving crown is mounted with axial play in a housing in the central core of said crown and comprises a part of non-circular cross section for engaging with a part of complementary cross section connected to said central core, elastic means being interposed between said stem and said crown to tend to bring the two parts of complementary non-circular cross sections into engagement with each other, said crown and said tube each comprising a screw thread suitable for screwing into each other and causing axial displacement of said crown against the pressure of said elastic means, causing separation of the two parts of complementary cross sections of said stem and said crown from each other.

10. Timepiece according to claim 8, in which the end of the stem connected to the driving crown is mounted with axial play in a housing in the central core of said crown and comprises a part of non-circular cross section for engaging with a part of complementary cross section connected to said central core, elastic means being interposed between said stem and said crown to tend to bring the two parts of complementary non-circular cross sections into engagement with each other, said crown and said tube each comprising a screw thread suitable for screwing into each other and causing axial displacement of said crown against the pressure of said elastic means, causing separation of the two parts of complementary cross sections of said stem and said crown from each other.

* * * * *